US005667605A

United States Patent [19]

Bellus et al.

[11] Patent Number: 5,667,605

[45] Date of Patent: Sep. 16, 1997

[54] METHOD OF FABRICATION OF A PIECE OF STRUCTURAL STEEL, AND THE STEEL FABRICATED THEREBY

[75] Inventors: Jacques Bellus, Scy-Chazelles; Claude Pichard, Malancourt; Pierre Jolly, Saint Etienne; Daniel Forest, Talange; Daniel Robat, Saint Julien les Metz, all of France

[73] Assignee: Ascometal, Puteaux, France

[21] Appl. No.: 569,348

[22] Filed: Dec. 8, 1995

[30] Foreign Application Priority Data

Dec. 13, 1994 [FR] France ..... 94 14941

[51] Int. Cl.[6] ..... C21D 9/00; C22C 38/18

[52] U.S. Cl. ..... 148/644; 148/333; 148/232; 148/567; 148/565

[58] Field of Search ..... 148/333, 644, 148/660, 661, 232, 567, 565

[56] References Cited

U.S. PATENT DOCUMENTS

| | | | |
|---|---|---|---|
| 3,682,721 | 8/1972 | Seulen et al. . | |
| 4,464,209 | 8/1984 | Taira et al. | 148/521 |
| 4,474,627 | 10/1984 | Maitrepierre et al. . | |
| 4,812,182 | 3/1989 | Fang et al. . | |
| 5,041,167 | 8/1991 | Miwa | 148/226 |

FOREIGN PATENT DOCUMENTS

| | | | |
|---|---|---|---|
| 0526330 | 3/1993 | European Pat. Off. . | |
| 2028325 | 9/1970 | France . | |
| 0092629 | 2/1983 | France . | |
| 1225217 | 9/1966 | Germany . | |
| 1263051 | 3/1968 | Germany . | |
| 56-130456 | 10/1981 | Japan | 148/333 |
| 59-28521 | 2/1984 | Japan | 148/660 |

*Primary Examiner*—Deborah Yee

*Attorney, Agent, or Firm*—Sixbey Friedman Leedom & Ferguson; Thomas W. Cole

[57] ABSTRACT

The invention relates to a method for fabricating a piece of structural steel that includes thermal or thermomechanical treatment steps that could ordinarily lower the fatigue strength and shock and impact resistance of the steel piece. In the method of the invention a workpiece of microalloy steel is fabricated containing the following elements in the mounts indicated and having a bainitic structure:

| | | | |
|---|---|---|---|
| C | 0.05–0.5 wt. % | Mo | 0–0.5 wt. % |
| Mn | 1–2 wt. % | V | 0–0.30 wt. % |
| Si | 0.05–1.5 wt. % | B | 0–0.010 wt. % |
| Cr | 0.1–1 wt. % | Ti | 0–0.030 wt. % |
| Nb | 0–0.1 wt. % | | |

The workpiece is then subjected to a treatment that includes a heating stage wherein at least a part of said piece is subjected to a temperature in the range 500°–900° C., followed by a cooling stage in which at least the part of the piece is subjected to cooling at a rate greater than 500° C./hr. The composition and bainitic structure of the workpiece prevents its fatigue strength and shock and impact resistance from lowering in the part heated within the 500°–900° C. range. The invention further encompasses the structural steel fabricated by the aforementioned method.

11 Claims, 1 Drawing Sheet

METHOD OF FABRICATION OF A PIECE OF STRUCTURAL STEEL, AND THE STEEL FABRICATED THEREBY

BACKGROUND OF THE INVENTION

The invention relates to thermomechanical treatment of pieces comprised of high grade microalloy steel, which treatment may consist of, e.g., forging, welding, or surface treatment.

In particular, steels of the following composition are used in producing high performance forgings:

| | |
|---|---|
| C | 0.05–0.5 wt. % |
| Mn | 1–2 wt. % |
| Si | 0.05–1.5 wt. % |
| Cr | 0.1–1 wt. % |
| Mo | 0–0.5 wt. % |
| V | 0–0.30 wt. % |
| B | 0–0.010 wt. % |
| Ti | 0–0.030 wt. % |
| Nb | 0–0.1 wt. % |
| Fe | (major component) |

Such steels may also include other alloying elements compatible with the intended uses, and various accompanying impurities not removed in processing. The resulting steel pieces may have a tensile strength of between 900–1200 MPa, e.g., and good resistance to transients (shock resistance and impact resistance). Such steels are classically used with a ferrito-perlitic structure which results naturally from secondary hardening during cooling in connection with the final forming operation. Such steels having a ferrito-perlitic structure can also be used for other applications requiring various thermal or thermomechanical treatments.

This type of metallurgical processing is well suited for forging and other operations carried out at elevated temperatures (greater than 1000° C., for example), for which the austenitization of the piece is complete. However, if part or all of the piece is subjected to lower heating temperatures in the range of 500°–900° C., problems can occur. Such a problematic situation may occur when the forging is only carried out on one end of a steel bar, and the heating (above 1000° C.) is confined to said end. The region of the bar which is not directly heated but which neighbors the zone to be forged becomes heated to a temperature which is lower but which is still sufficiently high to cause metallurgical changes in this region. A similar phenomenon occurs when the piece is subjected to welding, nitriding, or a thermal surface treatment such as laser tempering, or induction tempering—in such cases, the subsurface regions of the piece may be affected by the treatment in a manner which is very undesirable. Specifically, the parts of the piece subjected to such heating between 500° and 900° C. may be softened in a way which is detrimental to the strength of the piece, particularly its fatigue strength. One explanation of this softening phenomenon is that for the relatively low heating temperatures (500°–900° C.) the hardening effect of the interphase precipitations is reversed, and temperability is substantially reduced because of the very small grain size. As a result, the piece no longer has the desired properties, and in particular does not have them homogeneously throughout its entire volume.

Heretofore, attempts have been made to remedy this problem by employing chromium-molybdenum steels with tempering and annealing, or low alloy steels with a normalization treatment. However, these solutions limit the range of alloys and grades which can be employed. Further, where a thermal treatment to restore the mechanical properties of the piece is needed, it is generally accompanied by unacceptable deformations which necessitate some sort of correction, introducing appreciable additional time and costs into the manufacturing process for the piece.

SUMMARY OF THE INVENTION

The object of the present invention is to devise a method of fabrication of a piece of structural steel comprising the step of thermal or thermomechanical treatment of a workpiece of microalloy steel containing the following elements in the amounts indicated:

| | | | |
|---|---|---|---|
| C | 0.05–0.5 wt. % | Mo | 0–0.5 wt. % |
| Mn | 1–2 wt. % | V | 0–0.30 wt. % |
| Si | 0.05–1.5 wt. % | B | 0–0.010 wt. % |
| Cr | 0.1–1 wt. % | Ti | 0–0.030 wt. % |
| Nb | 0–0.1 wt. % | | |

characterized in that the piece has a bainitic structure; and in that the treatment comprises a heating stage wherein at least a part of the piece is subjected to a temperature in the range 500°–900° C., followed by a cooling stage in which the part (at least) of said piece is subjected to cooling at a rate greater than 500° C./hr.

The invention further encompasses a piece of structural steel produced by the aforementioned method.

As mentioned, the starting material for the invention is a microalloy structural steel workpiece having a bainitic structure which in the course of the treatment is, partly or entirely, purposely or by secondary effect, brought to a temperature in the range 500°–900° C. By starting with such a piece having the specified composition and a bainitic structure, one avoids the undesirable softening experienced with the use of a ferrito-perlitic starting material for the regions heated to 500°–900° C.

DETAILED DESCRIPTION OF THE PREFERRED EMBODIMENT

Figure 1:
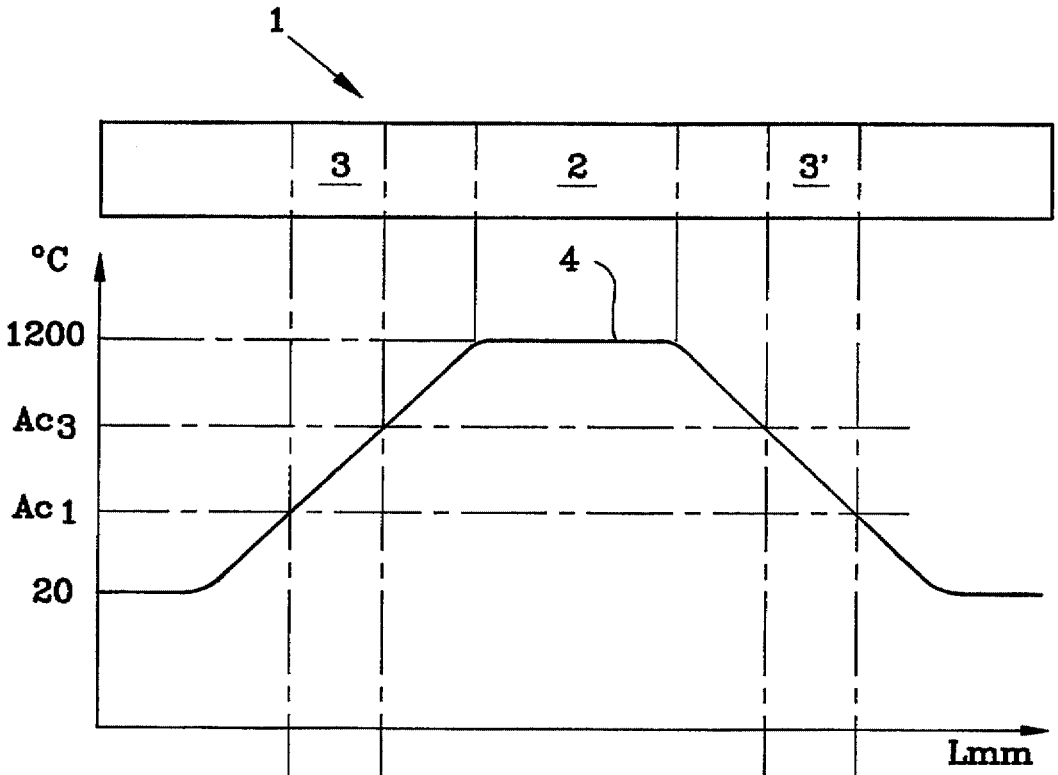
FIG. 1 illustrates both a workpiece and a graph indicating the temperature gradient of the workpiece when heated in a midsection thereof.
Figure 2:
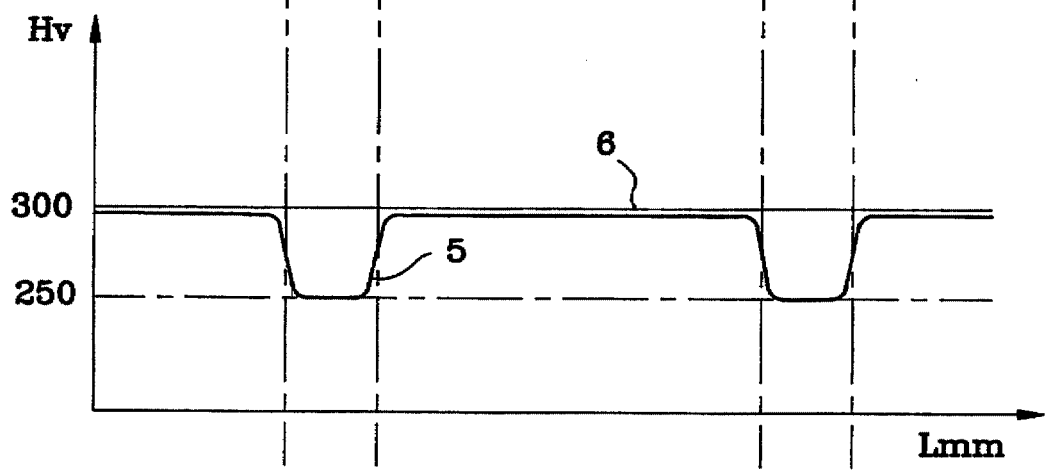
FIG. 2 is a graph comparing the hardness of a prior art workpiece with the hardness of a workpiece fabricated in accordance with the invention when both workpieces have been non-uniformly heated in accordance with the graph of FIG. 1.

The invention will be better understood with the aid of the following description, with reference to FIGS. 1 and 2 which illustrate an example of the application of the invention.

In FIG. 1, the part 2 of the bar 1 is the part which is heated. The dimensions of the bar 1 are 40 mm dia.×800 mm length (L). The bar is comprised of structural steel of the following composition:

| | | | |
|---|---|---|---|
| C | 0.35 wt. % | V | 0.12 wt. % |
| Mn | 1.8 wt. % | Mo | 0.050 wt. % |
| Si | 0.25 wt. % | B | 0.0005 wt. % |
| Ti | 0.012 wt. % | | |
| Fe | (major component), | | |

The bar also includes accompanying impurities which survived the production process, which process is typical of this type and grade of alloy. In one of the cases envisaged, the cooling conditions of the bar in connection with rolling have led, as is well known, to a ferrito-perlitic structure. In the other case envisaged, according to the invention, a bainitic structure has been obtained by means known to those skilled in the art with the aid of time-temperature transformation diagrams.

For the treatment of the bar 1, the central part 2 of the bar is heated, e.g. preparatory to forging. This heating results in a homogeneous temperature of c. 1200° C., over the entire thickness and length of the piece in the part 2. Outside of this central part 2 subjected directly to the heating means, the temperature of the piece 1 tends to decrease with distance from the central part 2, until at the ends of the bar the temperature is close to the ambient temperature of 20° C. As a result, in the parts designated 3 and 3' of the piece 1 a temperature is developed which is in the range between the classical temperatures Ac3 and Ac1 of the alloy of which the bar 1 is comprised. In the example shown in FIG. 1, these temperatures are 790° C. and 740° C., respectively, and the regions 3 and 3' each have a length of about 30 mm. The curve 4 in the graph of FIG. 1 shows the temperature profile developed along the length of the bar 1.

In an example where the bar 1 initially had a ferrito-perlitic structure, an appreciable softening of the structure occurs in the regions of the bar in which the temperature was in the range Ac3 to Ac1. This was reflected in a decrease in the Vickers hardness from about 300 to about 250 Hv, illustrated in the curve 5 in FIG. 2. The reasons for the softening were previously mentioned. In an example according to the invention, wherein the bar 1 was given a bainitic structure during rolling, the localized softening was not observed (curve 6 in FIG. 2). In such an instance, the mechanical properties which would have been affected by such softening remain homogeneous over the entire length of the piece after forging. In particular, the fatigue strength, sock resistance and impact resistance do not suffer degradation.

In the examples illustrated, the temperatures in the range 500°–900° C. which present the hazard of producing the softening phenomena sought to be avoided were generated indirectly, passively and non-purposively, with the direct heating being applied to a part of the piece other than that in which the temperatures in the 500°–900° C. range prevailed. However, it is also within the scope of the invention to produce such temperatures as a result of an influence on part (or all) of the piece in which such temperatures will prevail, in which case steps are taken in advance to provide the piece with a prescribed composition and a bainitic structure as stated above to avoid softening of the structure.

The heat treatment with which it is sought to avoid localized or general softening and weakening of the structure of the piece may be achieved by a variety of means and for a variety of purposes. Other than forging, the invention may also be utilized in connection with surface treatments such as laser tempering, induction tempering, electron beam bombardment, and nitriding treatments. The heating may also be a consequence of a welding operation or the like. Following the treatment, the piece is cooled at a rate which is not too slow; namely it is cooled at a rate of at least 500° C./hr so as to preserve the bainitic structure previously produced and to avoid possible softening.

It should be understood that the above lists of chemical elements which may be constituents of the composition of the steel are not exhaustive or limitative with regard to the scope of the invention. Other elements may be added within the scope of the invention if these elements do not impair the desired properties of the piece being fabricated.

The invention enables a wider range of compositions and grades of structural steel for the fabrication of structural steel pieces having desirable properties without regions of degradation in properties. The invention eliminates the need for subsequent thermal treatment to restore mechanical properties which have been detrimentally affected by softening of the structure such as described above, thereby providing savings in fabrication time and cost.

What is claimed:

1. A method of fabrication of a piece of structural steel, comprising thermal or thermomechanical treatment of a workpiece of microalloy steel containing the following elements in the amounts indicated:

| | | | |
|---|---|---|---|
| C | greater than 0.05 and up to 0.5 wt. % | Mo | 0–0.5 wt. % |
| Mn | greater than 1.3 but less than 2.0 wt. % | V | 0–0.30 wt. % |
| Si | 0.05–1.5 wt. % | B | 0–0.010 wt. % |
| Cr | 0.1–1 wt. % | Ti | 0–0.030 wt. % |
| Nb | 0–0.1 wt. % | | |

wherein said piece has a bainitic structure; and in that said treatment comprises a heating stage wherein only a part of said piece is subjected to a temperature in the range 500°–900° C. as a consequence of a thermal treatment performed on another part of the piece, followed by a cooling stage in which at least said part of said piece is subjected to cooling at a rate greater than 500° C./hr.

2. A method according to claim 1, characterized in that said heating is carried out preparatory to forging.

3. A method according to claim 1, wherein said heating is carried out in a nitriding treatment.

4. A method according to claim 1, wherein said heating is carried out in a surface heat treating process.

5. A method accordingly to claim 4, wherein said heating comprises laser tempering.

6. A method according to claim 4, wherein said heating comprises induction tempering.

7. A method according to claim 4, wherein said heating comprises electron beam bombardment.

8. A method according to claim 1, wherein said heating results from an operation of welding.

9. A piece of structural steel fabricated by the method according to claim 1.

10. A method according to claim 1, wherein the steel has a niobium content of less than 0.01wt %.

11. A piece of structural steel fabricated by the method according to claim 10.

* * * * *